US011642778B2

(12) United States Patent
Heath et al.

(10) Patent No.: US 11,642,778 B2
(45) Date of Patent: May 9, 2023

(54) MODULAR TOOL CONTAINER

(71) Applicant: MILWAUKEE ELECTRIC TOOL CORPORATION, Brookfield, WI (US)

(72) Inventors: Peter R. Heath, Wauwatosa, WI (US); Steven W. Hyma, Milwaukee, WI (US); Benjamin T. Jones, St. Francis, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 17/269,286

(22) PCT Filed: Sep. 9, 2019

(86) PCT No.: PCT/US2019/050168

§ 371 (c)(1),
(2) Date: Feb. 18, 2021

(87) PCT Pub. No.: WO2020/055726

PCT Pub. Date: Mar. 19, 2020

(65) Prior Publication Data

US 2021/0387325 A1 Dec. 16, 2021

Related U.S. Application Data

(60) Provisional application No. 62/728,891, filed on Sep. 10, 2018.

(51) Int. Cl.
*B25H 3/02* (2006.01)

(52) U.S. Cl.
CPC ..... *B25H 3/023* (2013.01)

(58) Field of Classification Search
CPC . B25H 3/003; B25H 3/00; B25H 3/02; B25H 3/023; B25H 3/025; B25H 3/021;
(Continued)

(56) References Cited

U.S. PATENT DOCUMENTS 2,341,635 A * 2/1944 Loesch ..... A63F 1/06 294/158
3,804,234 A * 4/1974 Gordon ..... B65D 5/50 229/185.1

(Continued)

FOREIGN PATENT DOCUMENTS

DE 202015100103 U1 2/2015
EP 2551067 B1 5/2016

(Continued)

OTHER PUBLICATIONS

International Search Report and Written Opinion for Application No. PCT/US2019/050168 dated Dec. 27, 2019 (10 pages).

(Continued)

*Primary Examiner* — Steven A. Reynolds
*Assistant Examiner* — Prince Pal
(74) *Attorney, Agent, or Firm* — Michael Best & Friedrich LLP

(57) ABSTRACT

A container includes a base, first recesses, a lid, and an insert. The base includes a lower surface. Base walls extend from the lower surface. The lower surface and the base walls define a cavity. The first recesses are positioned adjacent to the lower surface. The lid is movably coupled to the base to selectively enclose the cavity. The lid includes an upper surface and lid walls extend from the upper surface. The insert is positioned within the cavity and removably coupled to the lower surface of the base. The insert includes a projection received within one of the first recesses. The insert is engaged by the lid when the lid is closed.

19 Claims, 19 Drawing Sheets

(58) Field of Classification Search
CPC ..... B25H 3/06; B65D 25/107; B65D 45/16; B65D 58/20; B65D 25/10
USPC ..... 206/349, 372, 373, 379.493, 108, 6.1
See application file for complete search history.

(56) References Cited

U.S. PATENT DOCUMENTS 3,878,939 A * 4/1975 Wilcox ..... B25H 3/023 312/200
4,033,455 A * 7/1977 Robison ..... B65D 71/70 206/595
4,253,830 A 3/1981 Kazen et al.
4,424,899 A * 1/1984 Rosenberg ..... A45C 11/00 206/45.23
4,798,292 A * 1/1989 Hauze ..... A61L 2/26 206/439
4,871,354 A * 10/1989 Conn ..... A61J 1/2089 604/416
5,047,019 A 9/1991 Sincock
5,133,455 A 7/1992 Chow
5,165,539 A 11/1992 Weber et al.
5,353,930 A 10/1994 Berry, Jr.
5,398,810 A * 3/1995 Yao Wang ..... B25H 3/023 206/371
5,424,048 A 6/1995 Riley
5,464,091 A * 11/1995 Callahan ..... G11B 33/0438
5,570,784 A 11/1996 Sidabras et al.
5,676,254 A 10/1997 Cheng et al.
5,762,211 A 6/1998 Ensign
5,766,561 A 6/1998 Frieze et al.
5,823,332 A * 10/1998 Clausen ..... G11B 33/0433 211/41.12
5,826,719 A * 10/1998 Chen ..... B25H 3/028 312/902
5,855,274 A * 1/1999 Piao ..... B25H 3/04 206/478
6,109,436 A 8/2000 He
6,213,296 B1 * 4/2001 Streich ..... B25H 3/003 206/480
6,331,280 B1 12/2001 Wood
6,391,260 B1 5/2002 Davis et al.
6,405,864 B1 * 6/2002 Streich ..... B25H 3/003 206/443
6,415,922 B1 7/2002 Lee
6,470,930 B1 10/2002 Stottmann
6,634,728 B1 10/2003 Leguin
6,755,302 B1 * 6/2004 Streich ..... B25H 3/023 206/379
D495,067 S 8/2004 Winig et al.
6,769,538 B2 8/2004 Oswald
D498,005 S 11/2004 Winig et al.
6,953,114 B2 * 10/2005 Wang ..... B25H 3/003 206/375
6,991,103 B2 * 1/2006 Chen ..... B25H 3/003 206/379
7,048,133 B2 5/2006 Pangerc et al.
7,246,704 B2 7/2007 Brunson et al.
7,341,148 B2 3/2008 Bettenhausen et al.
7,434,688 B2 * 10/2008 Hu ..... B25H 3/023 206/379
7,601,312 B2 10/2009 Riley et al.
7,900,771 B1 * 3/2011 Meng ..... B25H 3/06 206/759
7,931,143 B1 * 4/2011 Lin ..... B25H 3/021 220/629
7,946,418 B1 5/2011 Cerynik
8,069,984 B2 * 12/2011 Larson ..... B25H 3/023 206/372
8,235,212 B2 * 8/2012 Heerens ..... G03F 7/707 206/454
8,251,211 B1 * 8/2012 Chen ..... B25H 3/025 220/811
8,336,708 B2 * 12/2012 Potterfield ..... B25H 3/02 206/459.5
8,371,444 B1 * 2/2013 Huang ..... B25H 3/003 206/374
D679,908 S 4/2013 Hurt et al.
8,505,720 B2 8/2013 Huang
8,915,363 B2 12/2014 Hawkes et al.
D725,388 S * 3/2015 Cole ..... D3/282
8,992,229 B2 * 3/2015 Spital ..... G09B 1/02 434/259
9,132,932 B2 * 9/2015 Scharfe ..... A47G 19/02
9,156,156 B2 * 10/2015 Wang ..... B25H 3/021
9,156,157 B2 * 10/2015 Wang ..... B65D 25/107
RE45,787 E * 11/2015 Hurt ..... D3/294
9,198,811 B2 12/2015 Pizzato et al.
9,254,565 B1 * 2/2016 Wang ..... B25H 3/003
D757,435 S 5/2016 Damberg
9,375,835 B1 * 6/2016 Lin ..... B25H 3/023
9,421,685 B2 * 8/2016 Meyers ..... B25H 3/006
9,486,912 B1 * 11/2016 Chen ..... B25H 3/02
9,610,126 B2 4/2017 Griffin
9,656,384 B1 * 5/2017 Tsai ..... B25H 3/003
9,694,489 B2 * 7/2017 Steele ..... B65D 25/205
9,975,237 B2 * 5/2018 Norris ..... B25H 3/06
10,058,230 B2 * 8/2018 Gobl ..... B65D 19/44
10,266,305 B2 4/2019 Lee et al.
10,286,541 B2 * 5/2019 Huang ..... B65D 21/0219
10,772,447 B2 9/2020 Roaks
11,358,272 B2 6/2022 Bühl et al.
2003/0213876 A1 * 11/2003 Takeuchi ..... H02G 3/32 248/74.1
2003/0221984 A1 12/2003 Huang
2005/0133394 A1 * 6/2005 Liu ..... A45C 11/00 206/349
2005/0211587 A1 * 9/2005 Chen ..... B25H 3/003 206/349
2005/0241974 A1 * 11/2005 Chen ..... B25H 3/003 206/349
2006/0011624 A1 * 1/2006 Shih ..... B25H 3/02 220/4.24
2006/0070900 A1 * 4/2006 Brunson ..... B25H 3/023 206/372
2007/0272572 A1 11/2007 Chen
2008/0060960 A1 * 3/2008 Hu ..... B25H 3/003 206/372
2009/0146032 A1 * 6/2009 Bettenhausen ..... A61B 50/30 248/220.31
2010/0140126 A1 * 6/2010 Lu ..... B65D 43/165 206/455
2011/0031145 A1 * 2/2011 Larson ..... B25H 3/003 206/372
2011/0111378 A1 * 5/2011 Nguyen ..... G09B 1/02 434/204
2011/0233096 A1 * 9/2011 Michels ..... B65D 25/205 206/459.5
2011/0290697 A1 * 12/2011 Dalhamer ..... A47G 23/06 206/557
2012/0043238 A1 * 2/2012 Christopher ..... B25H 3/003 206/375
2014/0166516 A1 * 6/2014 Martinez ..... A45F 5/021 206/372
2014/0231307 A1 * 8/2014 Wen ..... B25H 3/02 206/736
2014/0340034 A1 11/2014 Dietzel et al.
2015/0258676 A1 * 9/2015 Wang ..... B25H 3/021 206/349
2015/0258677 A1 * 9/2015 Wang ..... B65D 25/107 206/349
2016/0052125 A1 * 2/2016 Steele ..... B65D 25/205 206/349
2016/0053987 A1 * 2/2016 Hsu ..... B25H 3/02 206/372
2016/0107308 A1 * 4/2016 Hsu ..... B25H 3/003 206/349
2016/0290013 A1 * 10/2016 Lin ..... B25H 3/003
2016/0346915 A1 * 12/2016 Lin ..... B25H 3/02
2017/0165829 A1 * 6/2017 Damberg ..... A45C 13/02

(56) References Cited

U.S. PATENT DOCUMENTS

| | | | | |
|---|---|---|---|---|
| 2017/0341218 | A1 | 11/2017 | Maruzzo et al. | |
| 2017/0361454 | A1* | 12/2017 | Hsu | B25H 3/003 |
| 2019/0351540 | A1* | 11/2019 | Lamb | B25H 3/023 |
| 2020/0180138 | A1* | 6/2020 | D'Alessandro | B25H 3/00 |
| 2020/0200340 | A1* | 6/2020 | Pugh, II | F21V 23/04 |
| 2020/0238501 | A1* | 7/2020 | Baum | B25H 3/003 |
| 2021/0078159 | A1* | 3/2021 | Jiang | B65D 21/0213 |
| 2021/0146525 | A1* | 5/2021 | Spaulding, Jr. | B25H 3/02 |
| 2021/0197360 | A1* | 7/2021 | Zhang | B25H 3/006 |
| 2021/0245358 | A1* | 8/2021 | Hohl | B25H 3/06 |
| 2022/0355464 | A1 | 11/2022 | La Vardera | |

FOREIGN PATENT DOCUMENTS

| | | | |
|---|---|---|---|
| KR | 2019950010112 | Y1 | 11/1995 |
| WO | 0009421 | A1 | 2/2000 |

OTHER PUBLICATIONS

Bosch, "Bosch 2608580871 Hole Saw Set Speed for Multi-Construction (9-Piece)" <https://www.amazon.co.uk/Bosch-2608580871-Speed-Multi-Construction-9-Piece/dp/B00OWMC13E/ref...> web page publicly available at least as early as Jan. 22, 2018.

Extended European Search Report for Application No. 19859376.6 dated May 3, 2022 (9 pages).

* cited by examiner

MODULAR TOOL CONTAINER

CROSS-REFERENCE TO RELATED APPLICATION

This application is a national phase filing under 35 U.S.C. 371 of International Application No. PCT/US2019/050168 filed Sep. 9, 2019, which claims priority to U.S. Provisional Patent Application No. 62/728,891, filed Sep. 10, 2018, the entire contents of which are incorporated herein by reference.

FIELD

The present disclosure relates to a tool container or case, and more specifically, to a tool container or case with modular components allowing for user customization.

SUMMARY

In one aspect, a container includes a base, first recesses, a lid, and an insert. The base includes a lower surface. Base walls extend from the lower surface. The lower surface and the base walls define a cavity. The first recesses are positioned adjacent to the lower surface. The lid is movably coupled to the base to selectively enclose the cavity. The lid includes an upper surface and lid walls that extend from the upper surface. The insert is positioned within the cavity and removably coupled to the lower surface of the base. The insert includes a projection received within one of the first recesses. The insert is engaged by the lid when the lid is closed.

In another aspect, a container includes a base with a lower surface and base walls extending from the lower surface, a hinge pivotably coupled to the base, and a lid pivotably coupled to the hinge. The lower surface and the base walls define a cavity. The lid selectively encloses the cavity. The lid includes an upper surface and lid walls extending from the upper surface. The hinge is rotatable relative to the base about a first axis, and the lid is rotatable relative to the hinge about a second axis parallel to and spaced apart from the first axis. The lid is movable between a first position, in which the lid encloses the cavity, and a second position, in which the base rests on the lid.

In yet another aspect, a container includes a base, first recesses, a hinge, a lid, and an insert. The base includes a lower surface, base walls that extend from the lower surface, and a cavity defined by the lower surface and the base walls. The first recesses are positioned adjacent to the lower surface. The hinge is pivotably coupled to the base. The lid is pivotably coupled to the hinge to selectively enclose the cavity. The insert is positioned within the cavity. The insert includes a projection received within one of the first recesses. The lid is movable between a first position, in which the lid encloses the cavity, and a second position, in which the base rests on the lid. The lid engages the insert when the lid is in the first position.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

In general, the present disclosure relates to a container for storing tools. Modular components couple to the container and allow a user to store the tools in a variety of positions within the container. The container also includes a lid that is movable from a first position on top of the container, to a second position underneath the container.

Figure 1:
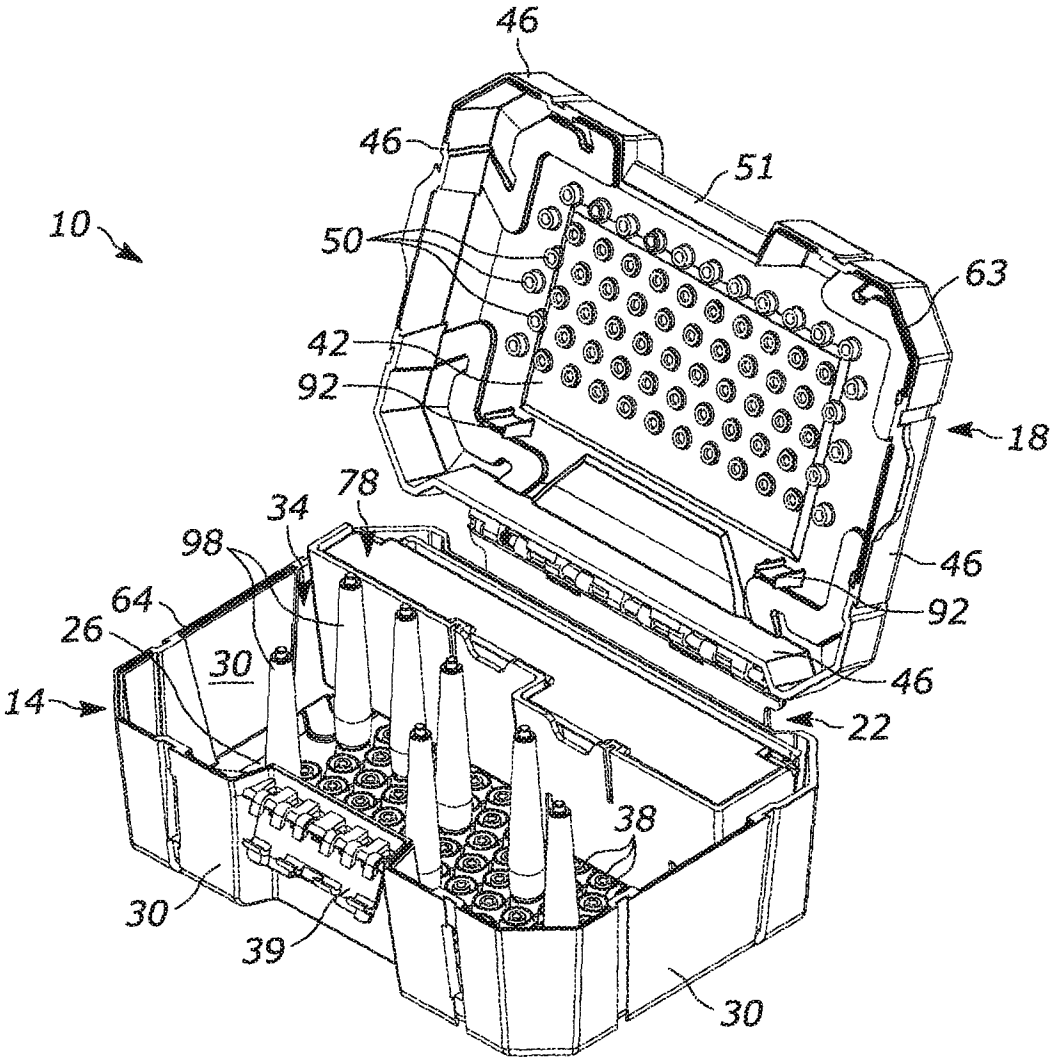
FIG. 1 is a perspective view of a tool container.
Figure 2:
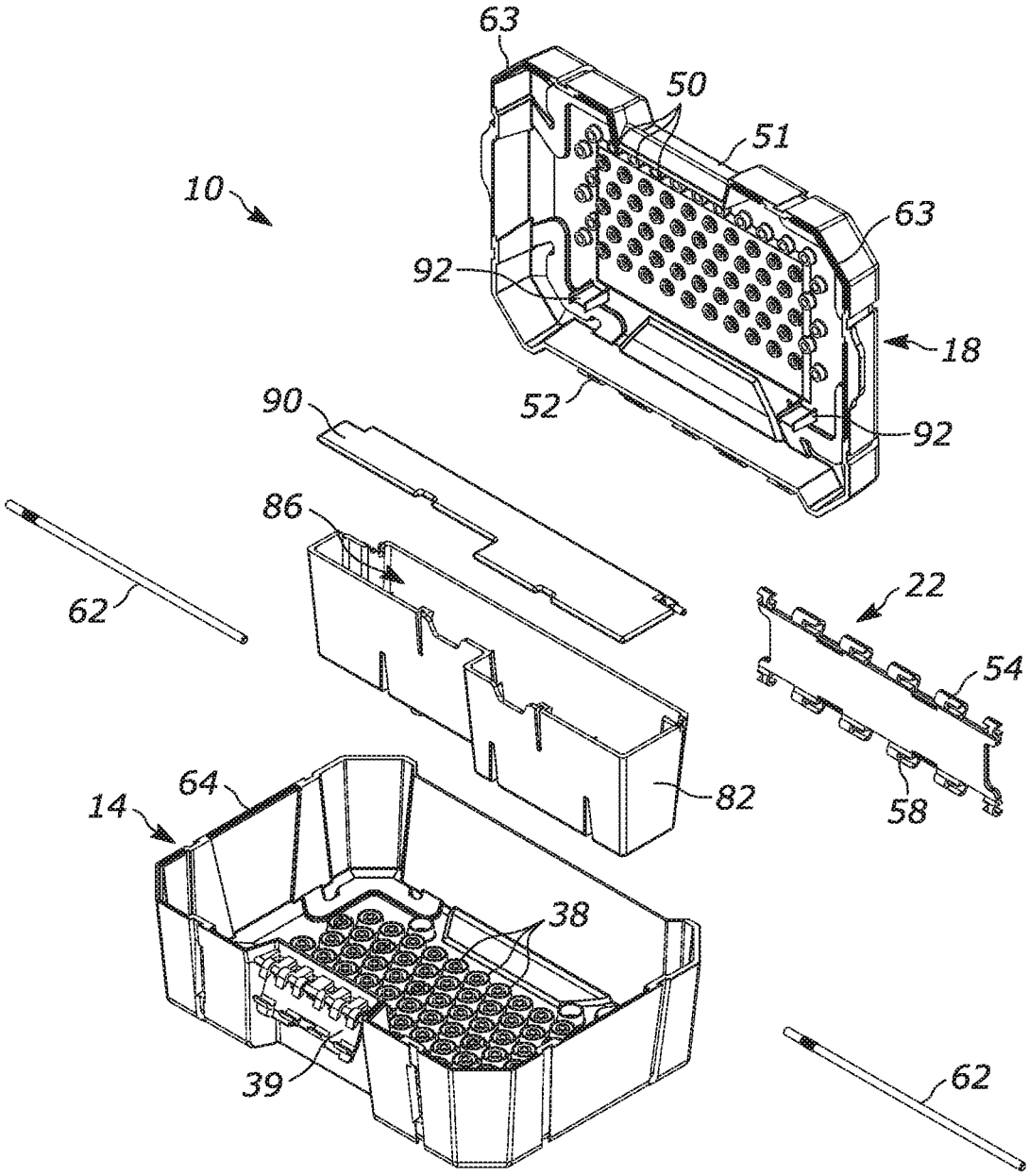
FIG. 2 is an exploded view of the tool container of FIG. 1.

As shown in FIGS. 1 and 2, a tool container or case 10 includes a base 14 coupled to a lid 18 by a hinge 22. The base 14 includes a first or lower surface 26 and walls 30 extending from the lower surface 26 and defining a cavity 34. In some embodiments, a handle (not shown) is coupled to at least one of the walls 30 or to the lid 18. The case 10 also includes recesses 38 positioned adjacent to the lower surface 26. In the illustrated embodiment, the recesses 38 are formed directly on the lower surfaces 26. The recesses 38 are generally circular in shape and each recess 38 includes an inner projection 41 (FIG. 3) that is spaced from the outer boundary of the recess 38. The recesses 38 are arranged in rows along the lower surface 26. In the illustrated embodiment, each row of recesses 38 is offset from adjacent rows of recesses 38.

Figure 3:
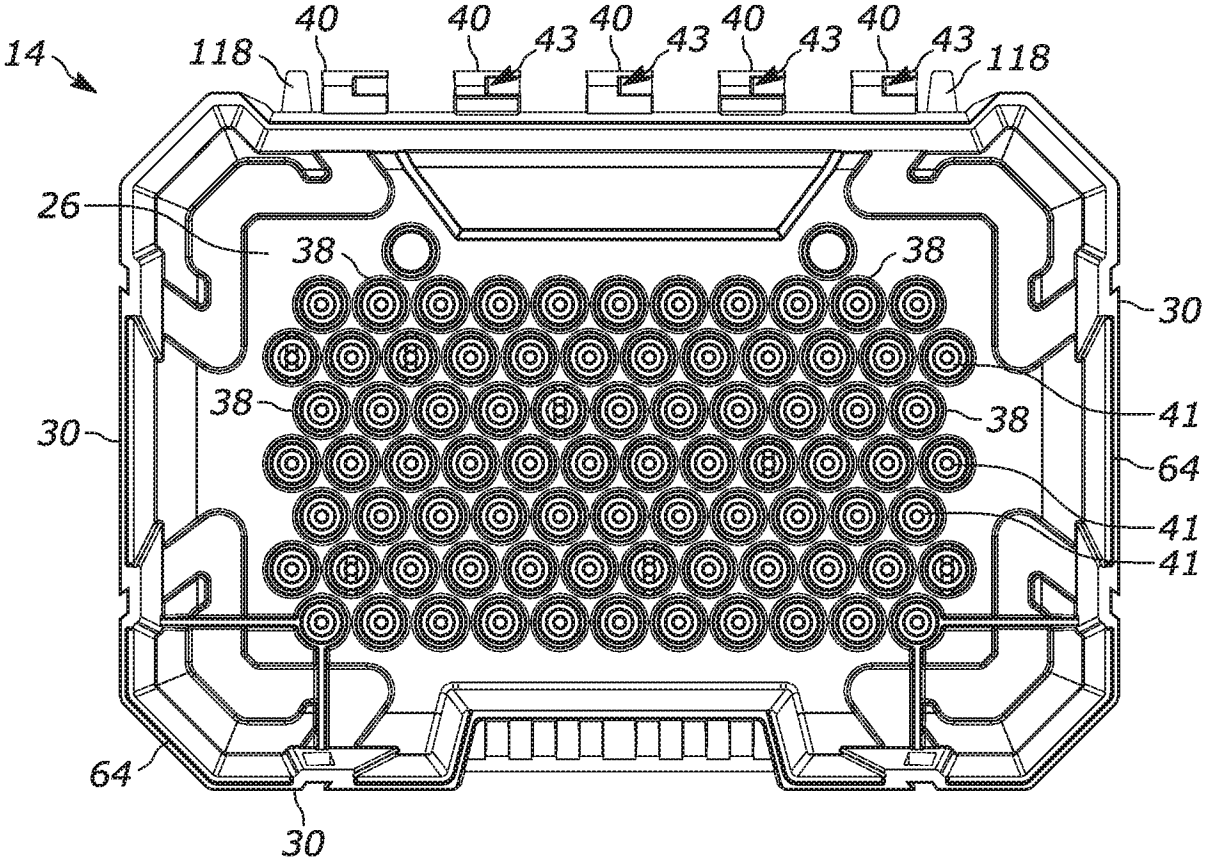
FIG. 3 is a top view of a base of the tool container of FIG. 1.

The base 14 also includes a first locking member or latch 39 and a first receiving portion 40. In the illustrated embodiment, the latch 39 is disposed on one wall 30, and the first receiving portion 40 is disposed on another wall 30 opposite wall 30 containing the latch 39. The latch 39 is movable (e.g., slidable, pivotable, detachable, etc.) relative to the wall 30. As shown in FIG. 3, the first receiving portion 40 includes a series of openings 43 for coupling to the hinge 22. Centers of the openings are aligned along an axis. In the illustrated embodiment, feet 118 are disposed on either side of the first receiving portion 40. The feet 118 have a triangular profile. The feet 118 inhibit the base 14 from tipping over.

Figure 10:
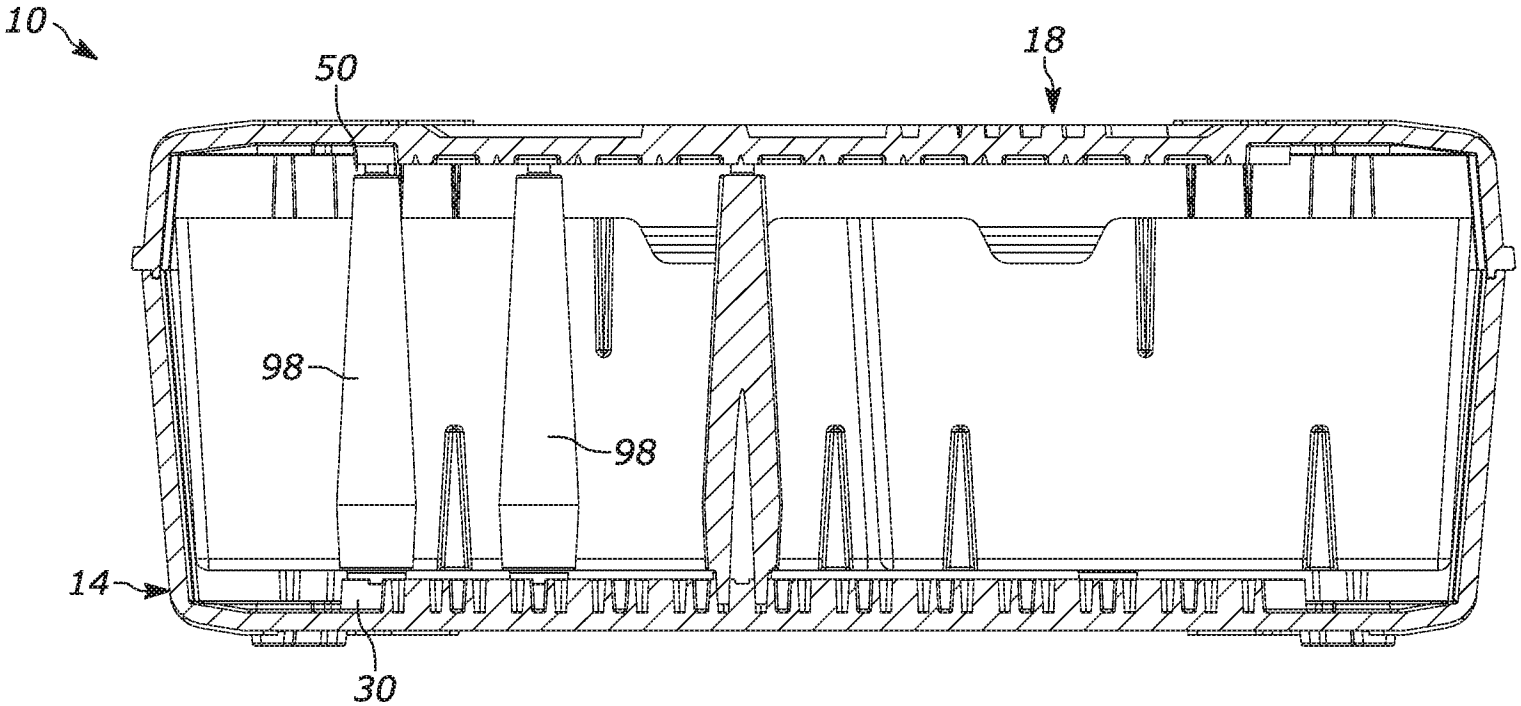
FIG. 10 is a cross-sectional view of the tool container with the lid in the closed position.

Returning to FIGS. 1 and 2, the lid 18 includes a first or upper surface 42 and walls 46 extending from the upper surface 42. The upper surface 42 includes recesses 50. In the illustrated embodiment, the recesses 50 are circular in shape and have a smaller diameter than the recesses 38. The recesses 50 are also arranged in rows along the upper surface 42. In the illustrated embodiment, each row of recesses 50 is offset from adjacent rows of recesses 50. When the lid 18 is closed (FIGS. 4 and 10), the recesses 50 of the lid 18 are substantially aligned with the recesses 38 of the base 14. In some embodiments, the recesses 50 also assist in the injection molding process, by eliminating the need for long core pins.

The lid 18 also includes a second locking member 51 and a second receiving portion 52. In the illustrated embodiment, the second locking member 51 is disposed on one wall 46, and the second receiving portion 52 is disposed on an opposite wall 46 from the second locking member 51. The second locking member 51 includes a projection that is fixed relative to the wall 46. The latch 39 selectively engages the second locking member 51 to secure the lid in a closed position. In the illustrated embodiment, the second receiving portion 52 includes a series of openings for coupling to the hinge 22. Centers of the openings are aligned along an axis.

The hinge 22 is an elongated body. In the illustrated embodiment, the hinge 22 is substantially rectangular in shape. A third receiving portion 54 is disposed along a first edge of the hinge 22, and a fourth receiving portion 58 is disposed along a second edge of the hinge 22 opposite the first edge. In the illustrated embodiment, the receiving portions 54, 58 include series of aligned openings. Centers of the openings of the third receiving portion 54 and centers of the openings of the fourth receiving portion 58 are each aligned along respective axes.

The first receiving portion 40 is aligned with the third receiving portion 54, and the second receiving portion 52 is aligned with the fourth receiving portion 58 (i.e., the centers of the series of openings making up the third and fourth receiving portions 54, 58 are aligned with the centers of the series of openings of the first and second receiving portions 40, 52 respectively). Rods or pins 62 are received in the adjacent receiving portions (e.g., the first and third receiving portions 40, 54 and the second and fourth receiving portions 52, 58). The rods 62 rotatably couple the hinge 22 to the base 14 and the lid 18.

Figure 4:
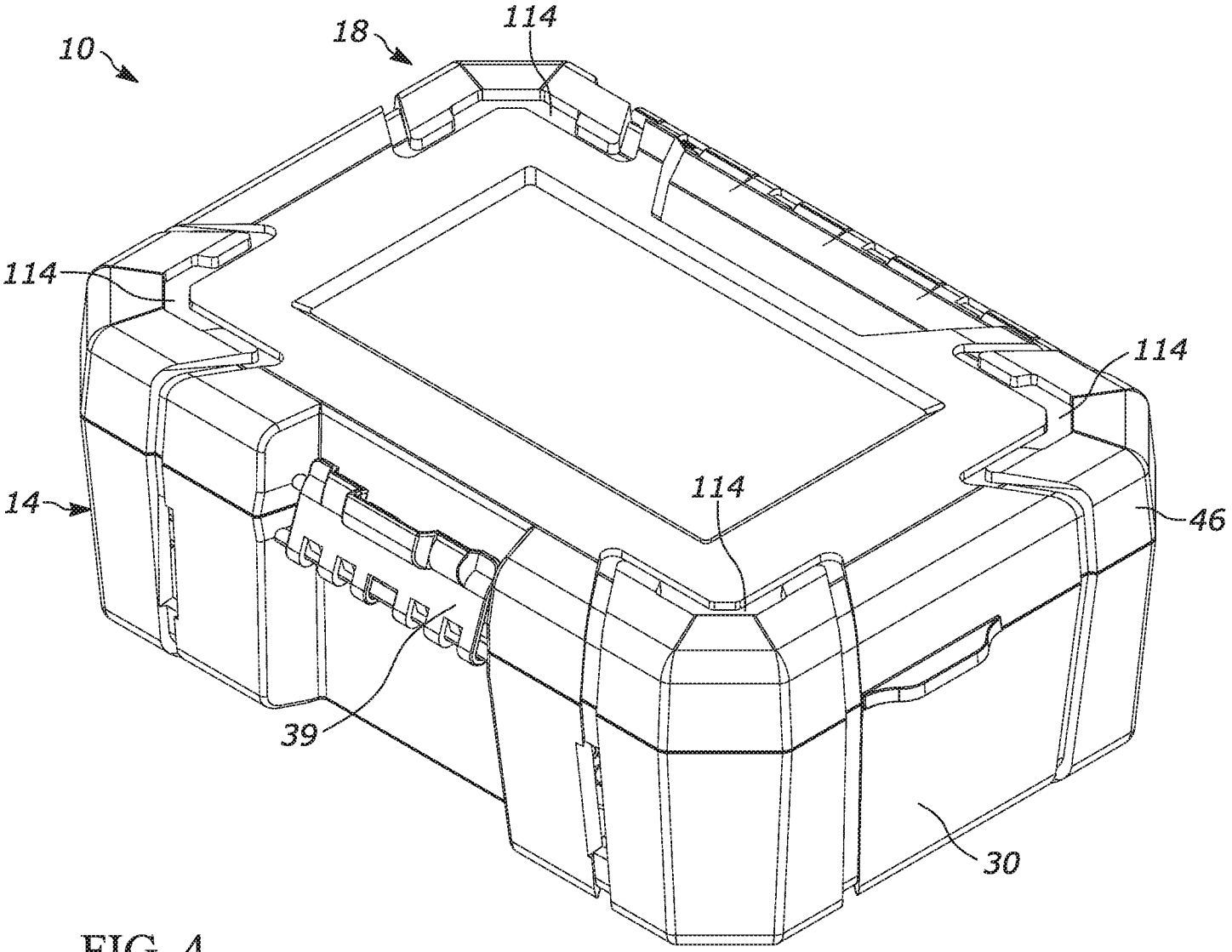
FIG. 4 is a perspective view of the tool container of FIG. 1, with a lid in a closed position.
Figure 5:
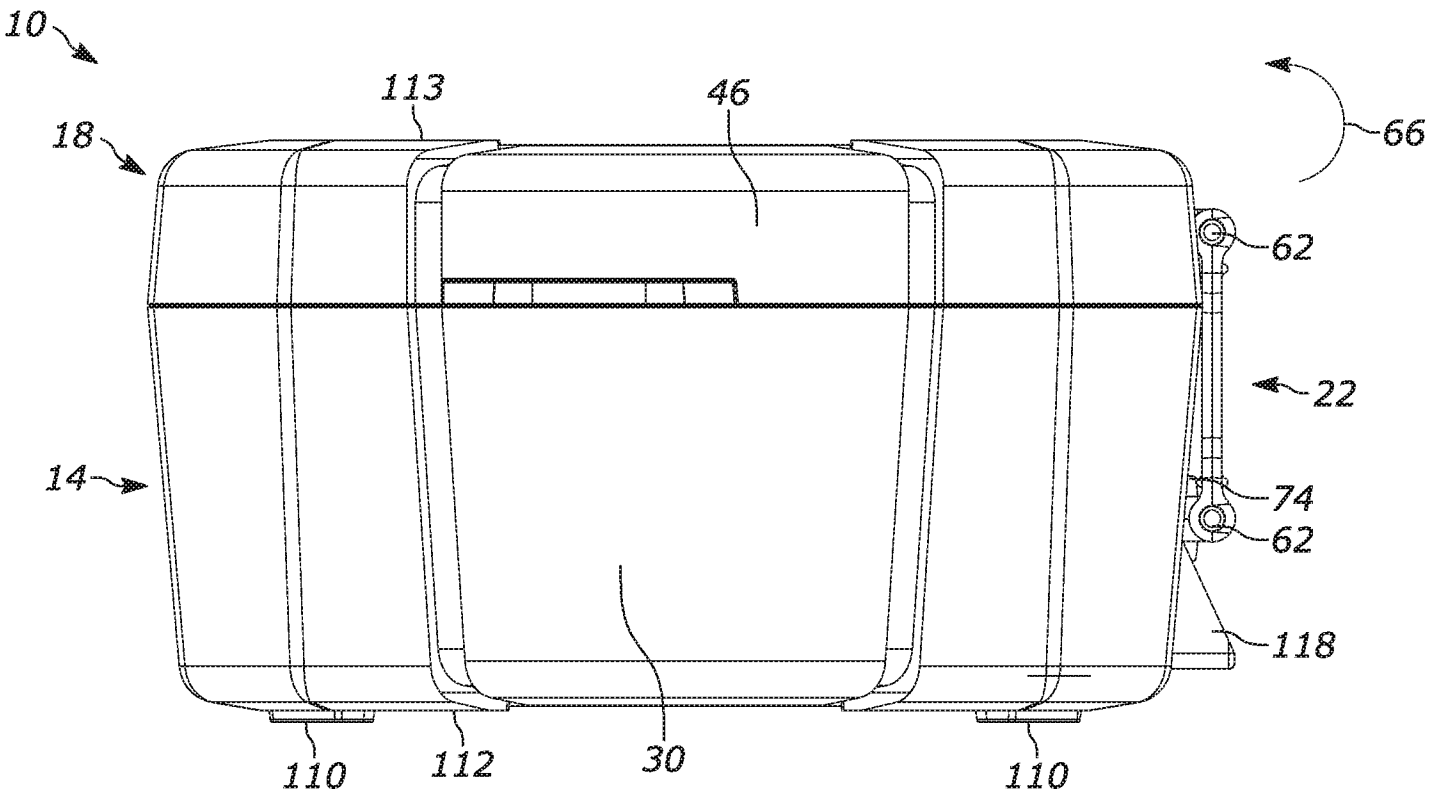
FIG. 5 is a side view of the tool container of FIG. 4.

As shown in FIGS. 4 and 5, the lid 18 is movable relative to the base 14 to a first or closed position. The hinge 22 is pivotable relative to the base 14, and the lid 18 is pivotable relative to the hinge 22. Both the hinge 22 and the lid 18 pivot in a first rotational direction identified by arrow 66 (e.g., counterclockwise in FIG. 5). In the illustrated embodiment, the hinge 22 is pivotable to a substantially vertical position, and the lid 18 is pivotable to a substantially orthogonal position relative to the hinge 22. In the illustrated embodiment, the base 14 includes stops 74 (FIG. 5), which extend from one of the walls 30. The hinge 22 pivots in the first rotational direction 66 toward the stops 74, and may pivot up to contacting the stops 74. The stops 74 prevent the hinge 22 from being acute with respect to the wall 30. In the closed position, the walls 46 of the lid 18 contact the walls 30 of the base 14. The two sets of walls 30, 46 interlock and help secure the case 10 in the event that the case 10 is dropped. In particular, the illustrated wall 46 includes a protrusion or projection 63 formed on a lower edge of the wall 46, while the illustrated wall 30 includes a gap or recess 64 formed in an upper edge of the wall 30. The recess 64 receives the projection 63 to form the interlock between the walls 30, 46. In other embodiments, the locations of the projection 63 and the recess 64 may be reversed, or the walls 30, 46 may include other features for creating an interlock between the walls 30, 46. In the illustrated embodiment, when the lid 18 is closed, the lower surface 26 faces the upper surface 42, and the recesses 38 are aligned with the recesses 50 (FIG. 1).

Before the lid 18 is closed, the latch 39 is moved along the wall 30, providing clearance for the second locking member 51. Once the lid is closed 18, the latch 39 is moved back along the wall 30 to engage the second locking member 51, thereby securing the lid 18 to the base 14. In some embodiments, the latch 39 may include a biasing member (e.g., a spring) to bias the latch 39 into engagement with the locking member 51. Additionally or alternatively, in some embodiments, the latch 39 may be pivotable relative to the wall 30 to engage and disengage the locking member 51. In further embodiments, other suitable types of latches may be used. In the illustrated embodiment, the lid 18 completely covers the cavity 34 in the closed position.

Figure 6:
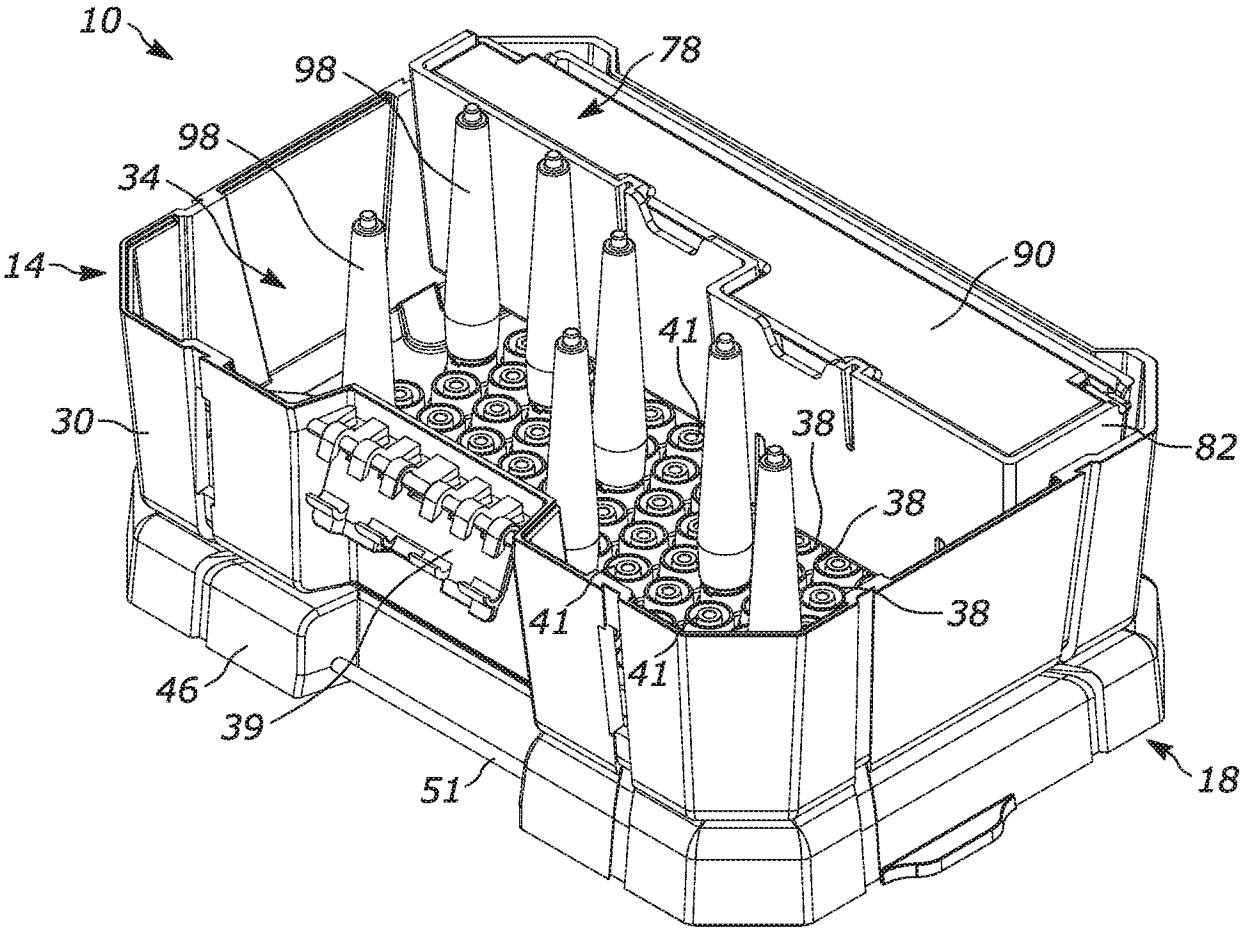
FIG. 6 is a perspective view of the tool container of FIG. 1, with the lid in an opened position.
Figure 7:
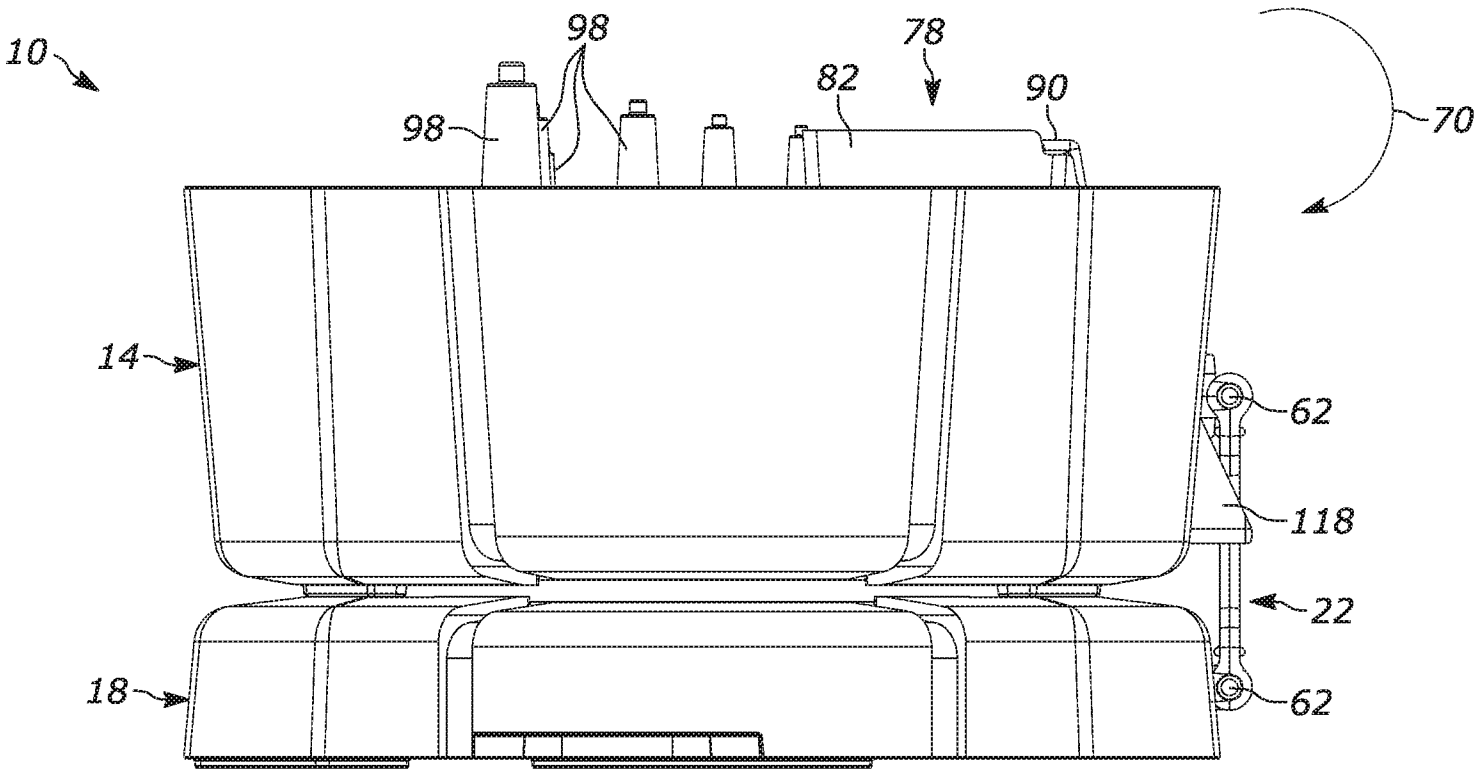
FIG. 7 is a side view of the tool container of FIG. 6, with the lid positioned beneath a base of the tool container.

As shown in FIGS. 6 and 7, the lid 18 is also movable relative to the base 14 to a second or fully open position. The hinge 22 and the lid 18 pivot in a second rotational direction identified by arrow 70 (e.g., clockwise in FIG. 7), which is opposite the first rotational direction 66 (FIG. 5). The lid 18 pivots in the second rotational direction 70 and allows the base 14 to rest on top of the lid 18 (i.e., the lower surface 26 faces in an opposite direction as the upper surface 42). In the illustrated embodiment, an outer surface 112 the base 14 opposite the lower surface 26 includes projections or feet 110 disposed proximate corners of the base 14 (FIG. 5). An outer surface 113 of the lid 18 opposite the upper surface 42 includes complementary depressions 114 (FIG. 4). The feet 110 mate with the depressions 114 when the base 14 rests on top of the lid 18, securing (e.g., via an interference fit) the lid 18 to the base 14 until the two are moved (e.g., pulled) apart by a user.

In the open positon, the cavity 34 is unobstructed (i.e., the lid 18 and the hinge 22 are not blocking the cavity 34). While in this position, a user may access the cavity 34 along any of the walls 30. In other situations (not shown), a user may not need to move the lid 18 to the fully open position, and may pivot the hinge 22 and the lid 18 in the second rotational direction 70 so that the lid 18 is spaced apart from the base 14, but that the base 14 does not rest on top of the lid 18. The fully open position, however, is also useful when displaying the case 10 in, for example, a store. The case 10 may be packaged (e.g., in a clear blister pack) while in the fully open position so that potential purchasers can see into the case prior to buying.

Figure 8:
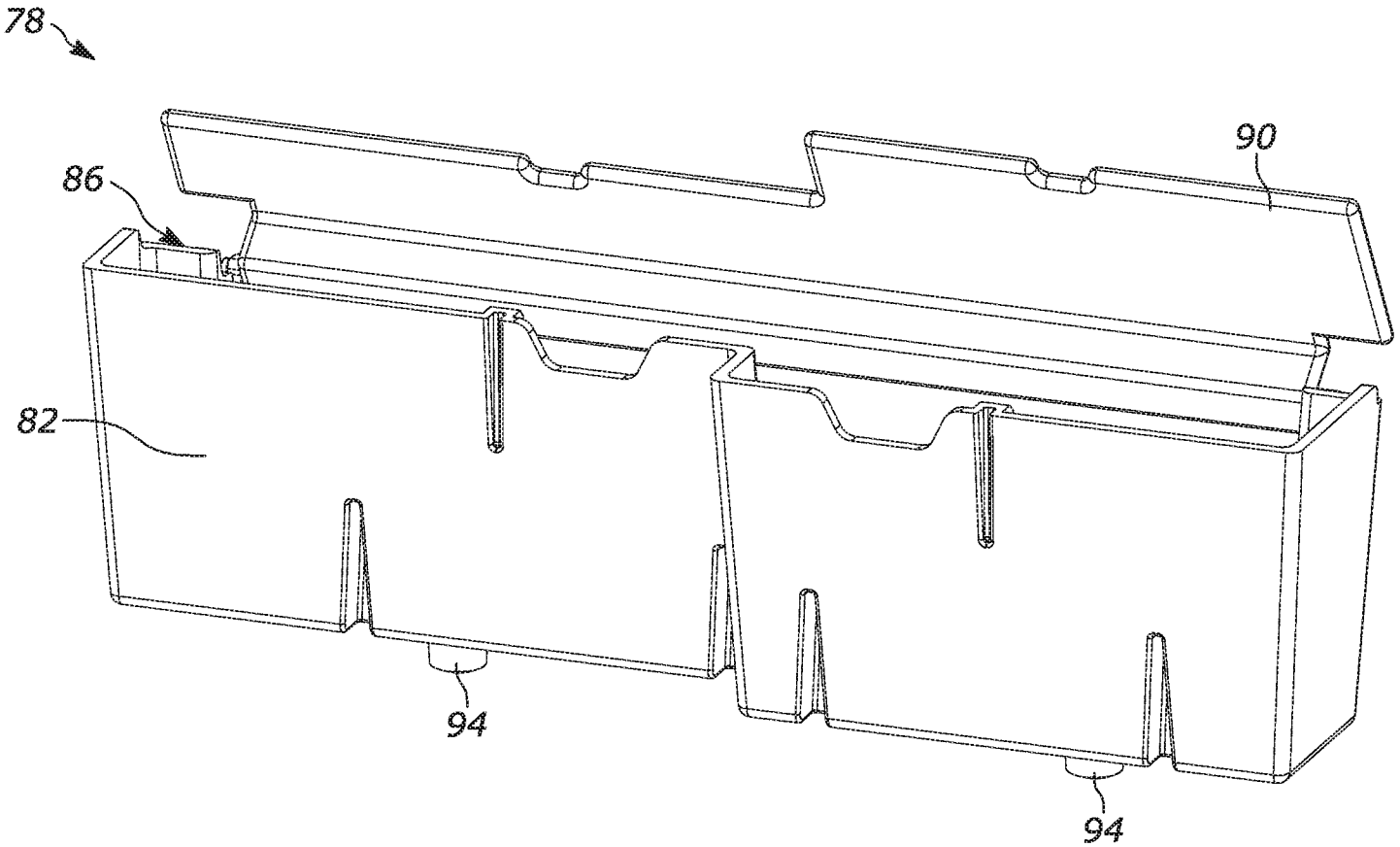
FIG. 8 is a perspective view of an insert for the tool container of FIG. 1.

The case 10 is used to store tools and tool accessories. For example, in the illustrated embodiment, the case 10 may be used to store hole saws and arbors. As shown in FIGS. 1 and 8, one or more first inserts are positioned within the cavity 34. In the illustrated embodiment, the first inset is an arbor box 78. The arbor box 78 includes a base 82 defining a compartment or cavity 86, a cover 90, and posts or pins 94. The cover 90 is movable (e.g., pivotable) relative to the base 82 and selectively covers the cavity 86 (FIG. 8). When the lid 18 is in the closed position (FIG. 4), the cover 90 is unable to open and expose the cavity 86. The lid 18 also includes two lugs 92 (FIG. 1), which engage the cover 90 when the lid 14 is in the closed position. The lugs 92 inhibit the cover 90 from opening in the event the case 10 is dropped. In the illustrated embodiment, the arbor box 78 includes two pins 94. The pins 94 are receivable in any of the recesses 38. A user may reposition the arbor box 78 anywhere within the case 10 by positioning the pins 94 within different recesses. Additional arbor boxes (not shown) may also be positioned within the case 10. The arbor box 78 is configured to store the arbor.

Figure 9:
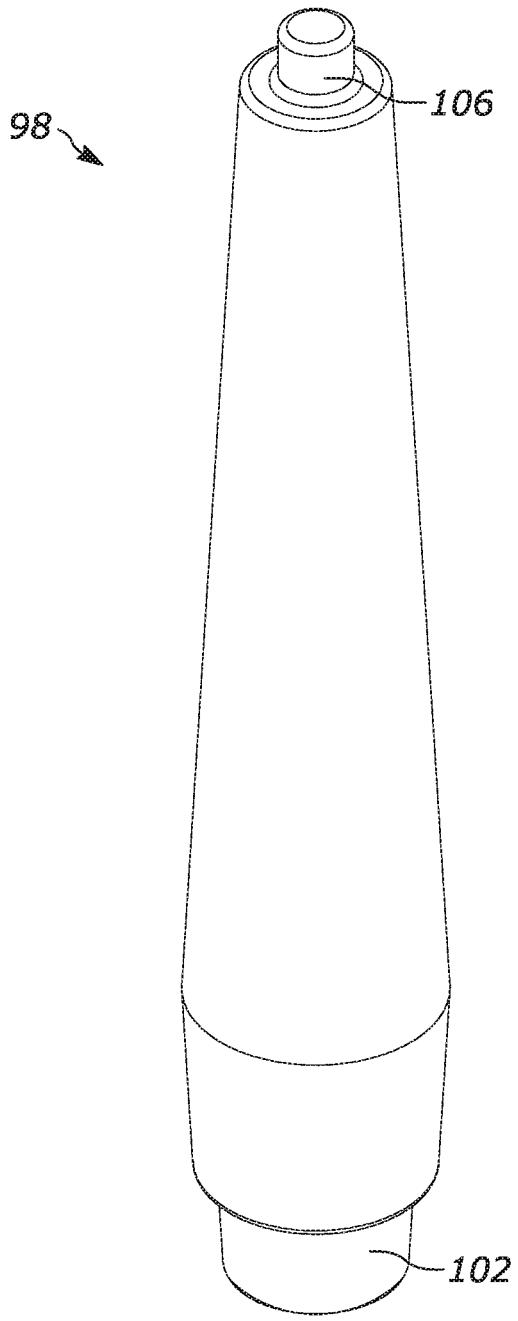
FIG. 9 is a perspective view of a pin.

As shown in FIGS. 1 and 9, one or more second inserts are also positioned within the cavity 34. In the illustrated embodiment, the second inserts are pegs 98. Each of the illustrated pegs 98 has an elongated body with a first end 102 and a second end 106. The first end 102 is larger (e.g., wider) than the second end 106. Each peg 98 is also tapered from the first end 102 to the second end 106 such that the pegs 98 are generally frustoconically-shaped. The first end 102 is positionable in any of the recesses 38 and mates with both the inner projection 41 and an outer diameter of the recess 38. The pegs 98 are configured to hold hole saws. For example, the hole saws slide over the second end 106 and onto one of the pegs 98. In some scenarios, the pegs 98 are configured to hold one or more hole saws with different diameters in stacked configurations. Moving the pegs 98 to different recesses 38 allows a user to store the hole saws in different configurations within the case 10.

When the lid 18 is in the closed position (FIG. 10), the second end 106 of the peg 98 is received within the recess 50 of the lid 18 that is aligned with the recess 38 of the base 14 in which the peg 98 is positioned. The peg 98 is then coupled to both the base 14 and the lid 18 and is unable to move relative to either. Any hole saws positioned on the pegs 98 are unable to fall off the pegs 98 while the lid 18 is in the closed position. The pegs 98 also would not come loose if the case 10 was dropped because the pegs 98 are coupled to the base 14 and the lid 18 at both ends 102, 106.

Figure 11:
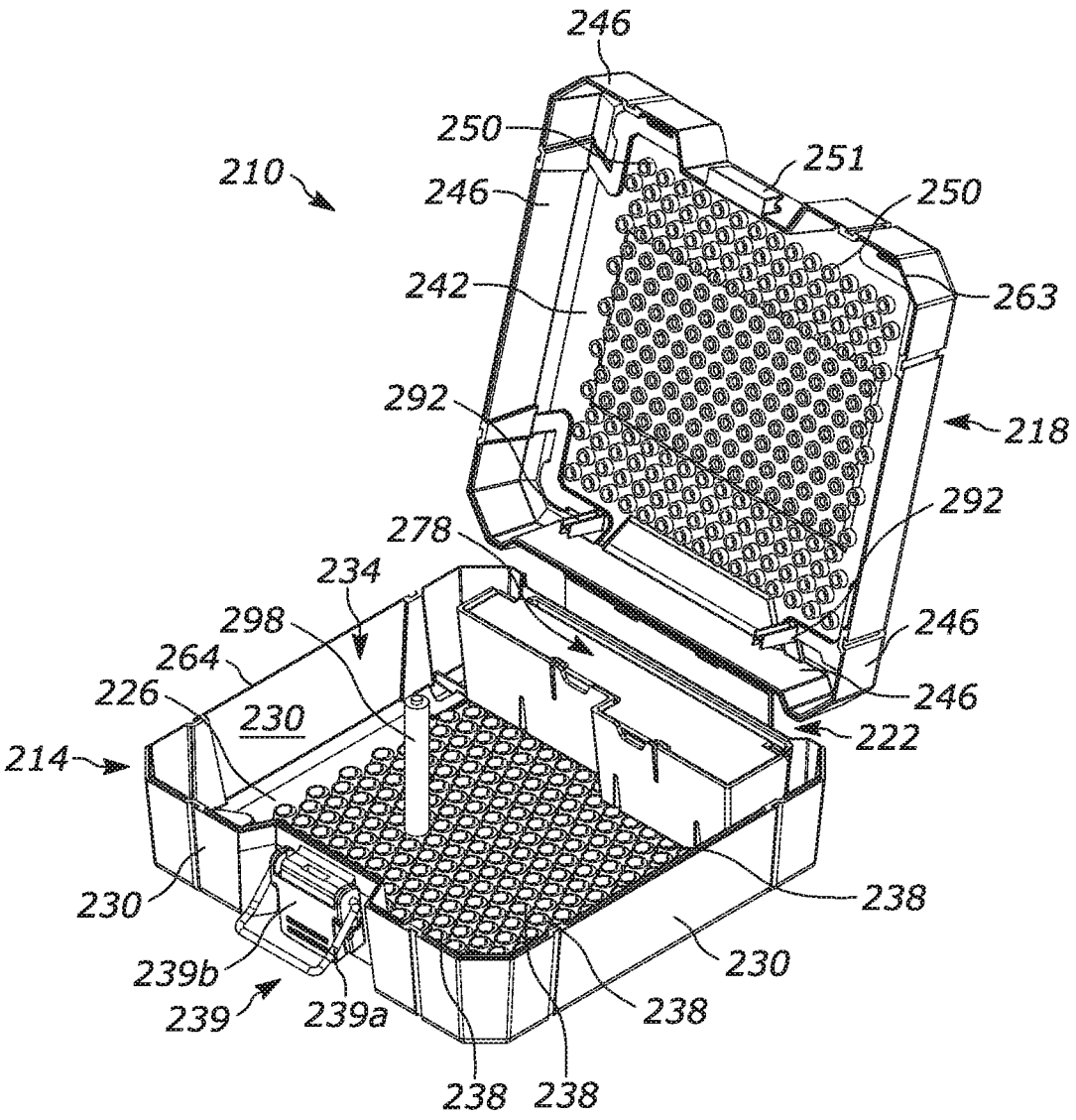
FIG. 11 is a perspective view of a tool container according to another embodiment.
Figure 12:
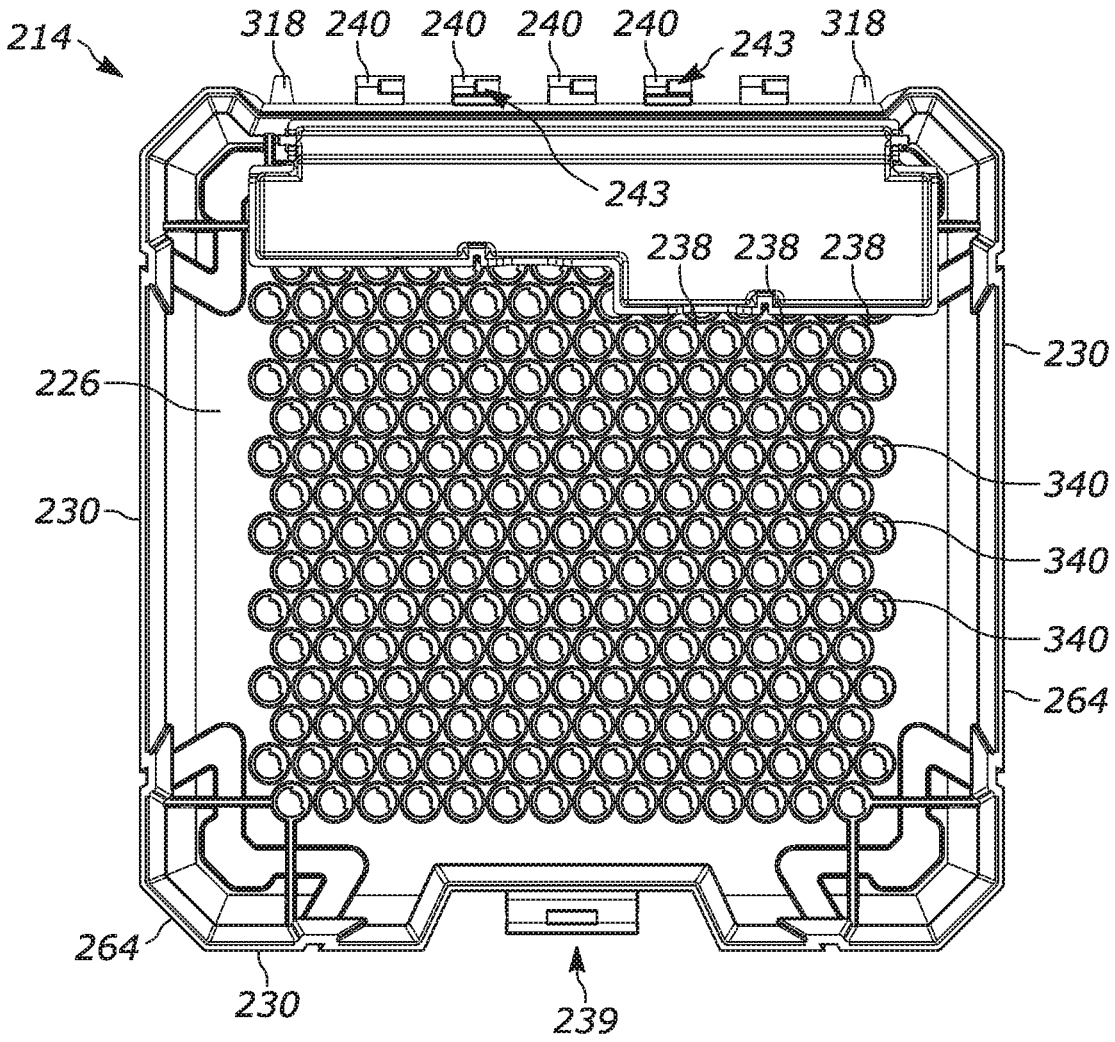
FIG. 12 is a top view of a base of the tool container of FIG. 11.
Figure 13:
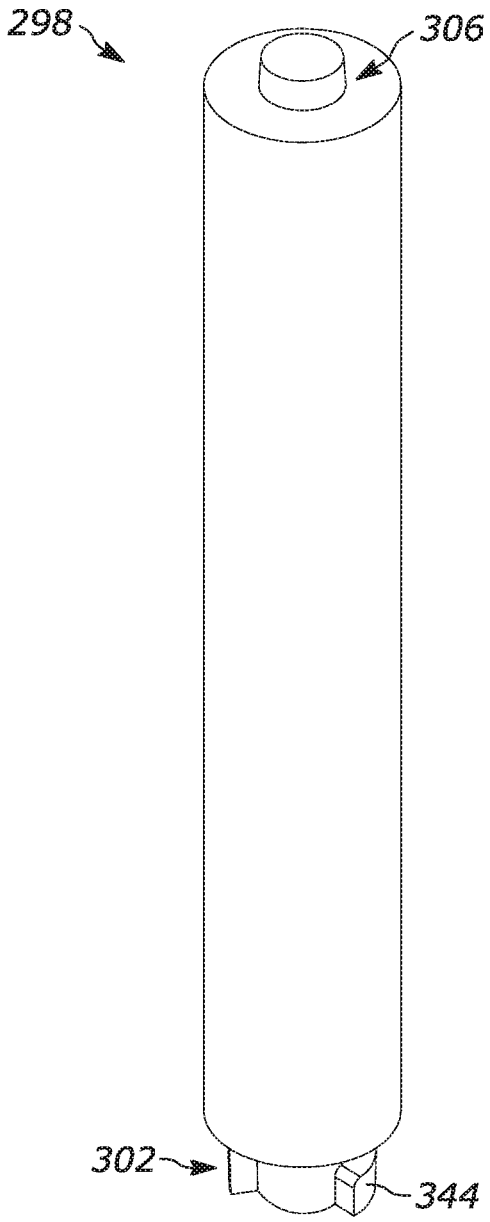
FIG. 13 is a perspective view of a pin of another embodiment.

FIGS. 11-13 illustrate a tool case 210 that is substantially similar to tool case 10. Similar features include the same reference number, plus "200". Only some differences and similarities between the tool case 210 and the tool case 10 will be described below.

As shown in FIGS. 11 and 12, the tool case 210 has a larger volume than the tool case 10, and includes a base 214 and a lid 218 that each have a larger surface area than the base 14 and the lid 18 of the tool case 10. The larger surface areas allow the base 214 and the lid 218 to include more recesses 238, 250 respectively. The recesses 238 are positioned adjacent to a lower surface 226. In the illustrated embodiment, the recesses 238 are formed directly on the lower surface 226.

The tool case 210 also includes a first locking member or latch (e.g., a toggle latch) 239 with a first movable piece **239*a* and a second moveable piece 239*b*. In the illustrated embodiment, the first movable piece 239*a* is a bar that is pivotable relative to the base 214 and engages the second locking member 251 on the lid 218. The second moveable piece 239*b* is also pivotable relative to the base 214 between a locked position adjacent a wall 230, and an unlocked position spaced from the wall 230. In the locked position, the first movable piece 239*a* is unable to engage or disengage the second locking member 251**.

As shown in FIG. 12, each recess 238 on the lower surface 226 of the base 214 includes a bayonet channel 340. In the illustrated embodiment, the bayonet channel 340 extends around a portion of each recess 238. Each bayonet channel 340 may receive a peg 298 (FIG. 13). In the illustrated embodiment, the peg 298 includes a complementary bayonet projection 344 at the first end 302. The bayonet projection 344 engages the bayonet channel 340 to secure the peg 298 to the base 214 in an orthogonal position relative to the lower surface 226. In other embodiments, the pegs 298 may be threaded, and may be received within a threaded recess 238.

Figure 14:
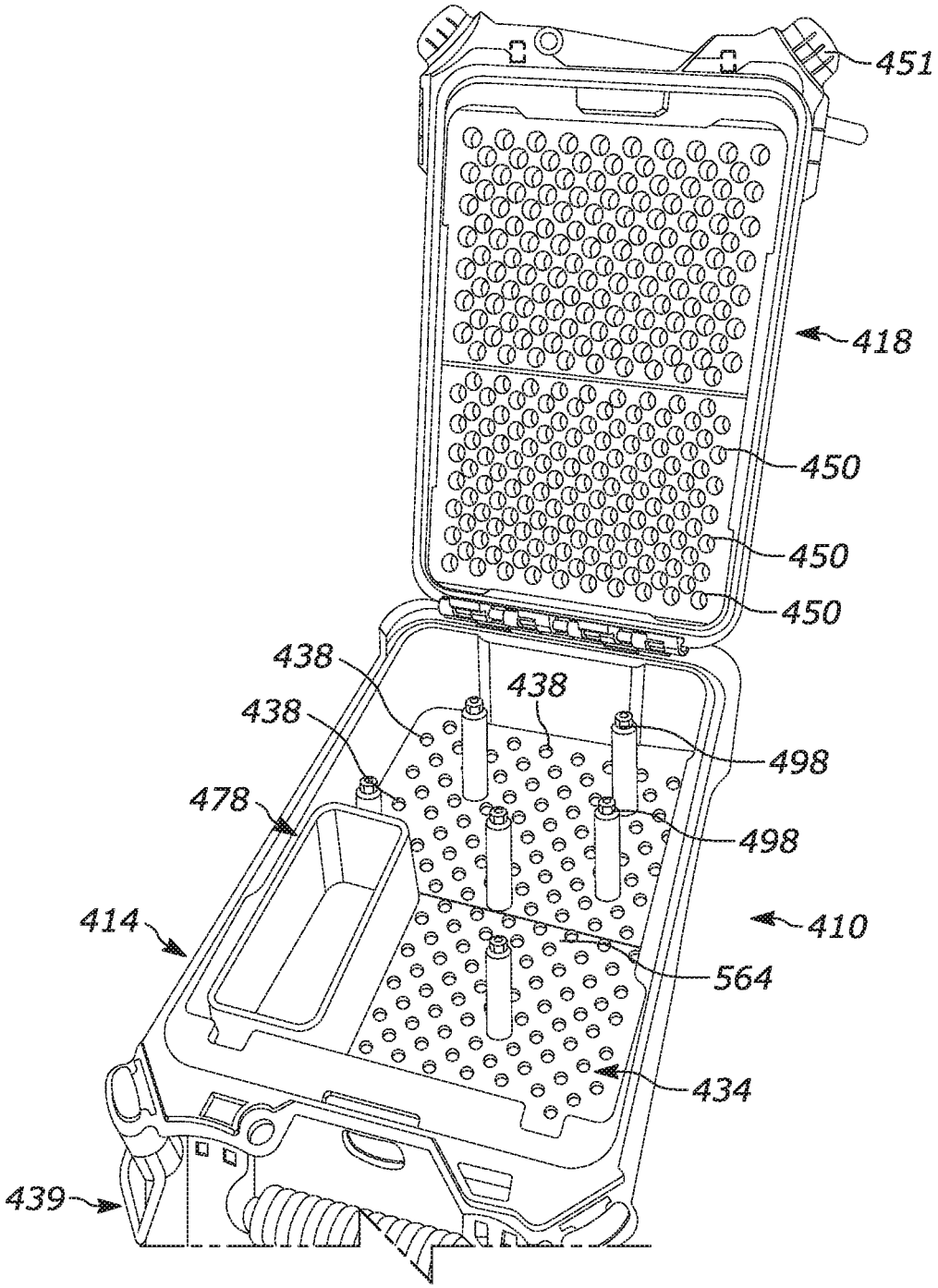
FIG. 14 is a perspective view of a tool container according to yet another embodiment.
Figure 15:
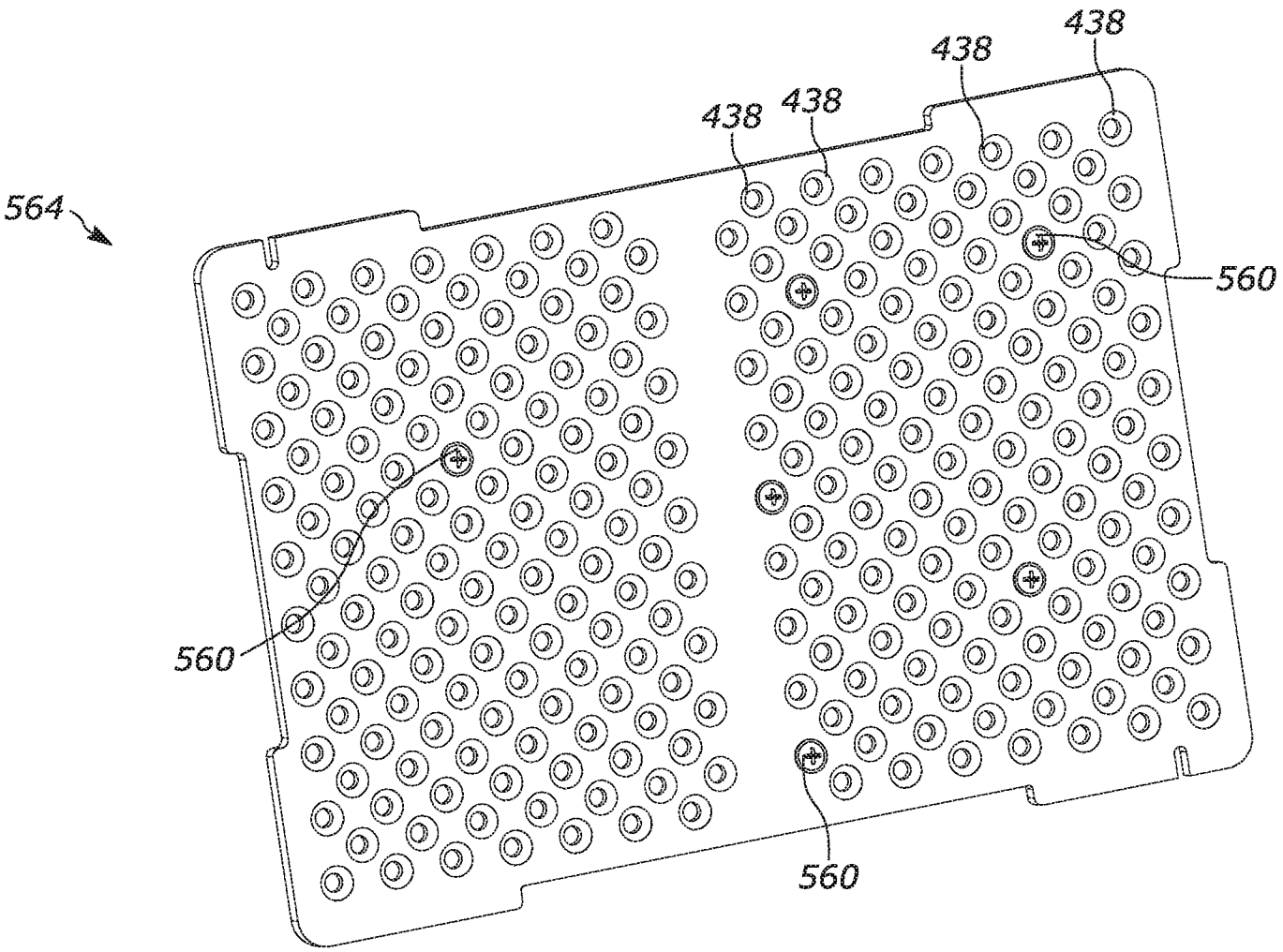
FIG. 15 is a perspective view of an insert of the tool container of FIG. 14.

FIGS. 14 and 15 illustrate a tool case 410 that is substantially similar to tool case 10. Similar features include the same reference number, plus "400". Only some differences and similarities between the tool case 410 and the tool case 10 will be described below.

As shown in FIGS. 14 and 15, each peg 498 is coupled to the base using a fastening member 560 (e.g., a threaded screw). The tool case 410 includes recesses 438 positioned adjacent to a lower surface of the base 414. In the illustrated embodiment, the base 414 includes a removable panel or insert 564 coupled to the base 414. The insert 564 includes the recesses 438 (i.e., the recesses 438 are not formed directly on the base 414). A user may remove the insert 564 from the base 414 and insert a screw 560 through one of the recesses 238. The user may then couple a peg 498 to the screw 560, which secures the peg 498 in an orthogonal position relative to the insert 564. The peg 498 is thereby secured to the corresponding recess 438 by the screw 560. The user then repositions the insert 564 within the base 514. In other embodiments, at least a portion of the peg 498 may be threaded, and may be received within a threaded recess 438.

FIGS. 16-19 illustrate a tool case 610 that is substantially similar to tool case 10. Similar features include the same reference number, plus "600". For example, the tool case 610 includes a locking member 651, lugs 692, walls 646, a hinge 622, a latch 639, a recess 664, an upper surface 642, a projection 663, a third receiving portion 654, a fourth receiving portion 658, a second receiving portion 652, a cover 690, a cavity 686, pins 662, a first receiving portion 640, feet 718, and openings 643. Only some differences and similarities between the tool case 610 and the tool case 10 will be described below.

Figure 16:
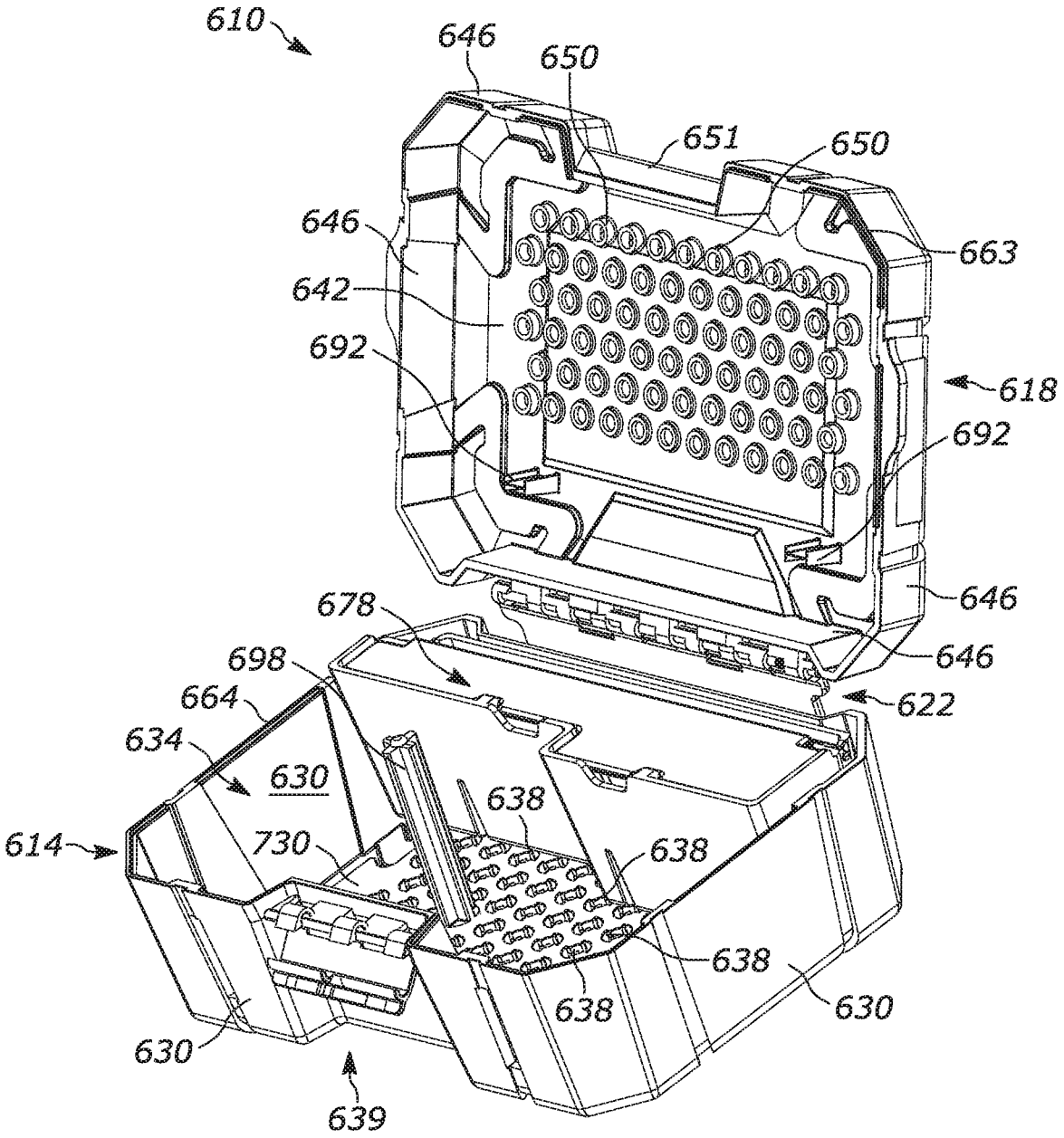
FIG. 16 is a perspective view of a tool container according to another embodiment.
Figure 17:
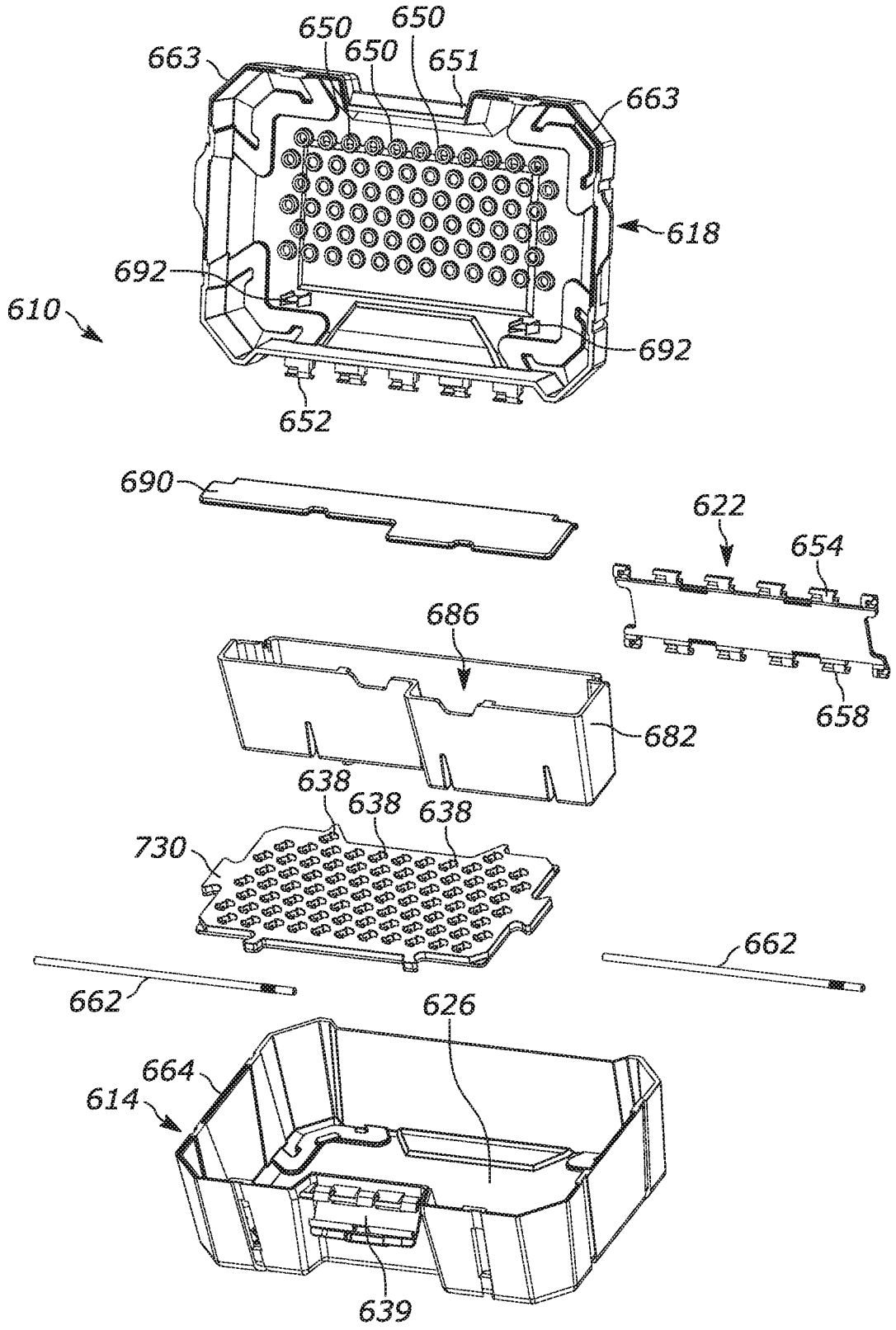
FIG. 17 is an exploded view of the tool container of FIG. 16.
Figure 18:
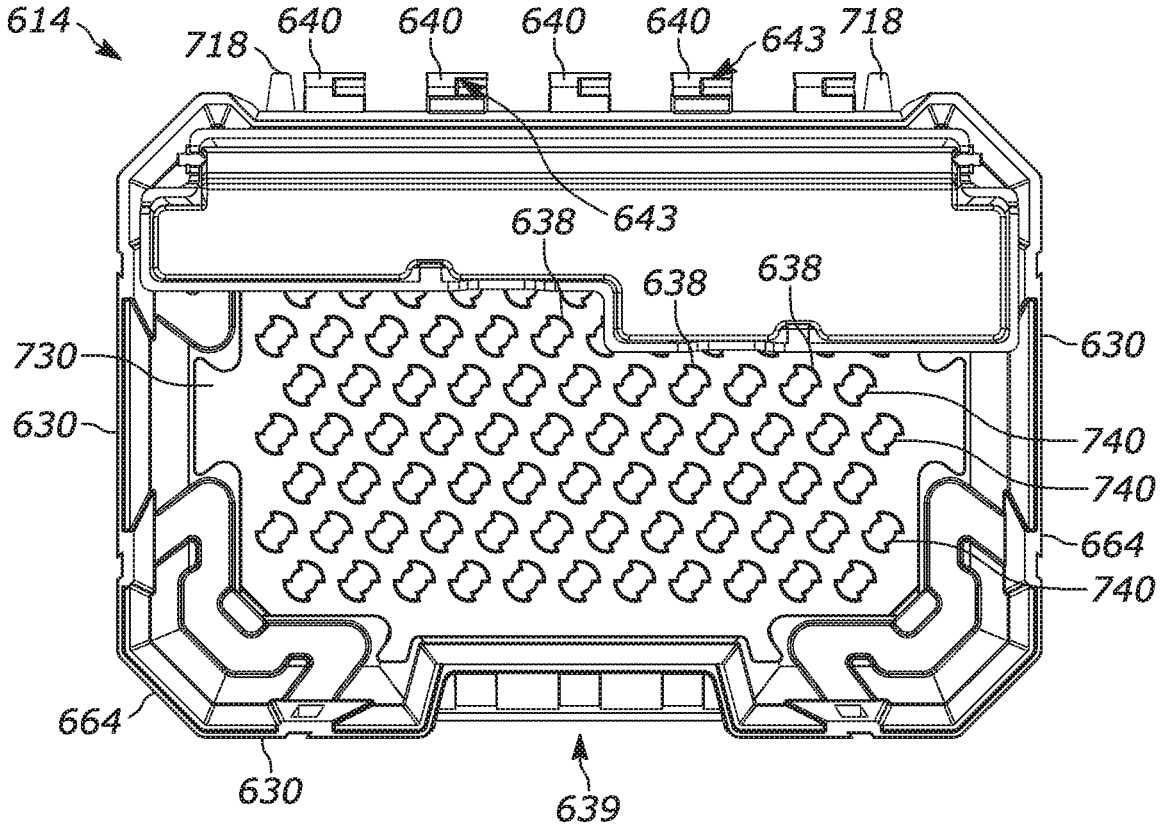
FIG. 18 is a top view of a base of the tool container of FIG. 16.

As shown in FIGS. 16-18, the tool case 610 includes a base 614 with a first or lower surface 626 and walls 630 extending from the lower surface 626 and defining a cavity 634. The tool case 610 includes recesses 638 positioned adjacent to the lower surface 626. In the illustrated embodiment, a removable panel or insert 730 is coupled to the lower surface 626 of the base 614. The removable insert 730 includes recesses 638 (i.e., the recesses 638 are not formed directly on the lower surface 626). The recesses 638 are arranged in rows along the removable insert 730. In the illustrated embodiment, each row of recesses 638 is offset from adjacent rows of recesses 638. Each recess 638 includes a double bayonet shape (i.e., the recess 638 includes a pair of bayonet channels 740). In other words, the recesses 638 define a partially circular shape, with the pair over bayonet channels 740 defining overhangs that extend toward a center of the respective recess 638.

Figure 19:
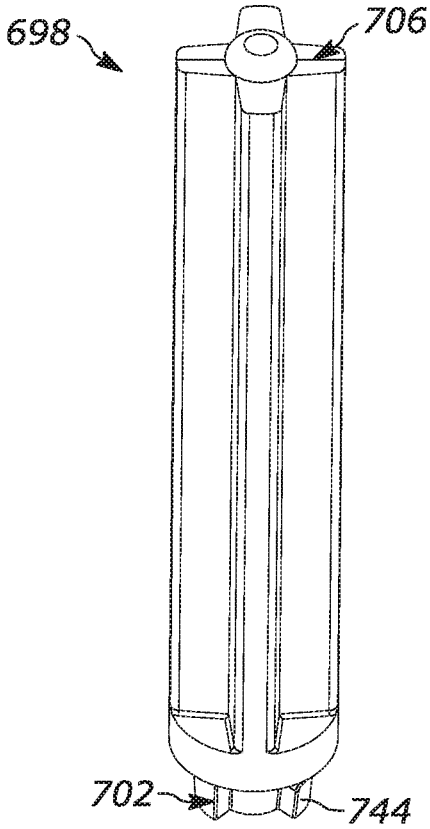
FIG. 19 is a perspective view of a pin used with the tool container of FIG. 16.

As shown in FIG. 19, a peg 698 may be received in any of the recesses 638. The peg 698 includes an elongated body with a first end 702 and a second end 706. The first end 702 includes a bayonet projection 744 that engages a bayonet channel 740 in order to secure the peg 698 to the removable insert 730 in an orthogonal position relative to the removable insert 730. The second end 706 of the peg 698 is received within the recess 650 of the lid 618 that is aligned with the recess 638 of the base 614. In the illustrated embodiment, the second end 706 has a semi-spherical shape and is receivable within a generally circular shaped recess 650. The elongated body of the peg 698 also has an X-shape. Specifically, the peg 698 has an x-shaped cross-section when taken through a horizontal plane (with respect to FIG. 19). The base 682 of the arbor box 678 may include cylindrical pegs (not shown) with a diameter less than the distance between the bayonet channels 740. In other words, the arbor box 678 is not coupled to the removable insert 730 with a bayonet engagement.

The embodiment(s) described above and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described.

What is claimed is:

1. A container comprising:

a base including a lower surface, base walls extending from the lower surface, and a cavity defined by the lower surface and the base walls;

first recesses positioned adjacent to the lower surface;

a lid movably coupled to the base to selectively enclose the cavity, the lid including an upper surface and lid walls extending from the upper surface; and an insert positioned within the cavity and removably coupled to the lower surface of the base, the insert including a projection received within one of the first recesses, wherein the insert is engaged by the lid when the lid is closed, and wherein the insert includes a peg configured to hold a hole saw, wherein the peg includes a first end removably receivable within one of the first recesses and a second end opposite the first end, and wherein the second end is engaged by the lid when the lid is closed.

2. The container of claim 1, wherein the upper surface includes second recesses, and wherein the second end of the peg is removably received within one of the second recesses when the lid is closed.

3. The container of claim 2, wherein each first recess is aligned with one respective second recess.

4. The container of claim 3, wherein the first recesses and the second recesses are arranged in rows offset relative to one another.

5. The container of claim 1, wherein the projection is a bayonet projection, wherein the one of the first recesses includes a bayonet channel, and wherein the peg is removably coupled to the one of the first recesses with a bayonet style coupling.

6. The container of claim 1, wherein the peg has a generally X-shaped body.

7. The container of claim 1, wherein the peg is secured to the one of the first recesses by a fastening member.

8. The container of claim 1, wherein the insert includes an arbor box with a base defining a compartment configured to store an arbor, and a cover selectively enclosing the compartment.

9. The container of claim 8, wherein the projection is a post extending from the base of the arbor box and removably received within the one of the first recesses.

10. The container of claim 8, wherein the lid includes a lug extending from the upper surface and engaging the cover when the lid is closed.

11. The container of claim 1, further comprising a panel removably positionable within the cavity, the panel having the first recesses.

12. The container of claim 1, further comprising a hinge coupled between the base and the lid, wherein the hinge is rotatable relative to the base about a first axis, wherein the lid is rotatable relative to the hinge about a second axis parallel to and spaced apart from the first axis, and wherein the lid and the base are moveable independently with respect to the hinge.

13. The container of claim 12, wherein the lid is movable between a first position, in which the lid encloses the cavity, and a second position, in which the base rests on the lid.

14. A container comprising:

a base including a lower surface, base walls extending from the lower surface, and a cavity defined by the lower surface and the base walls;

a container supported within the cavity on the lower surface and configured to store one or more accessories, the container including a base defining a compartment and a cover moveable relative the base to enclose a compartment;

a hinge pivotably coupled to the base; and a lid pivotably coupled to the hinge to selectively enclose the cavity, the lid including an upper surface and lid walls extending from the upper surface, the lid further including a lug extending from the upper surface;

wherein the hinge is rotatable relative to the base about a first axis, and the lid is rotatable relative to the hinge about a second axis parallel to and spaced apart from the first axis, and wherein the lid is movable between a first position, in which the lid encloses the cavity and the lug contacts the cover, and a second position, in which the base rests on the lid.

15. The container of claim 14, wherein the hinge is pivotable relative to the base in a first rotational direction and in a second rotational direction; and the lid is pivotable relative to the hinge in the first rotational direction and in the second rotational direction.

16. The container of claim 14, wherein the lid further includes a first locking member and the base further includes a second locking member, the first and second locking members configured to couple to one another while the lid encloses the cavity.

17. The container of claim 14, further comprising:

first recesses positioned adjacent to the lower surface; and an insert positioned within the cavity and removably coupled to the lower surface of the base, the insert including a projection received within one of the first recesses.

18. The container of claim 14, wherein the base includes a foot coupled to a first outer surface of the base opposite the lower surface, wherein the lid includes a depression formed on a second outer surface of the lid opposite the upper surface, and wherein the foot is received in the depression when the lid is in the second position.

19. The container of claim 14, wherein an upper edge of the base walls includes one of a gap or a protrusion, wherein a lower edge of the lid walls includes another of the gap or the protrusion, and wherein the protrusion is received within the gap when the lid is in the first position.

* * * * *